US008550593B2

(12) United States Patent
Narita

(10) Patent No.: US 8,550,593 B2
(45) Date of Patent: Oct. 8, 2013

(54) PRINTER

(75) Inventor: Hiroshi Narita, Higashichikuma-gun (JP)

(73) Assignee: Seiko Epson Corporation, Tokyo (JP)

( * ) Notice: Subject to any disclaimer, the term of this patent is extended or adjusted under 35 U.S.C. 154(b) by 215 days.

(21) Appl. No.: 12/963,552

(22) Filed: Dec. 8, 2010

(65) Prior Publication Data

US 2011/0141211 A1 Jun. 16, 2011

(30) Foreign Application Priority Data

Dec. 10, 2009 (JP) ..... 2009-280178
Dec. 10, 2009 (JP) ..... 2009-280179

(51) Int. Cl.
*B41J 23/00* (2006.01)
*B41J 2/17* (2006.01)
*B41J 2/175* (2006.01)

(52) U.S. Cl.
USPC ..... 347/37; 347/84; 347/85; 347/86

(58) Field of Classification Search
USPC ..... 347/37, 38, 84, 85, 86
See application file for complete search history.

(56) References Cited

U.S. PATENT DOCUMENTS 5,751,300 A 5/1998 Cowger et al.
6,582,067 B2 6/2003 Matsuzaki et al.
6,929,358 B2 8/2005 Matsuzaki et al.
7,059,712 B2 6/2006 Matsuzaki et al.
7,278,696 B2 10/2007 Matsuzaki et al.
7,537,322 B2 * 5/2009 Ishikawa et al. ..... 347/85

FOREIGN PATENT DOCUMENTS

JP 59-136280 A 8/1984
JP 05-138990 A 6/1993
JP 05-169671 A 7/1993
JP 07-251507 A 10/1995
JP 08-258253 A 10/1996
JP 2001-270132 A 10/2001
JP 2003-048328 A 2/2003
JP 2004-066696 A 3/2004
JP 2007-203563 A 8/2007
JP 2009-083386 A 4/2009
JP 2009-083510 A 4/2009

* cited by examiner

*Primary Examiner* — Jannelle M Lebron
(74) *Attorney, Agent, or Firm* — Kilpatrick Townsend & Stockton LLP

(57) ABSTRACT

A printer has a pair of frame panels that support the ends of a carriage guide shaft, a carriage that carries a print head, a carriage drive motor, and first and second pulleys on which a belt connected to the carriage is mounted. The first and second pulleys limit the range of bidirectional carriage movement so that the maximum width of carriage movement is substantially equal to the width between the pair of frame panels. A tube that carries ink to the print head is disposed curving in a U-shape in the direction of the width between the pair of frame panels. The carriage drive motor is disposed in the space in which the tube is located in the space on the opposite side as the direction in which the tube curves, and the drive shaft of the carriage drive motor is perpendicular to the scanning plane of the carriage.

7 Claims, 5 Drawing Sheets

PRINTER

This application claims priority to Japanese Patent Application No. 2009-280178, filed Dec. 10, 2009 and Japanese Patent Application No. 2009-280179, filed Dec. 10, 2009, the entireties of which are incorporated by reference herein.

BACKGROUND

1. Technical Field

The present invention relates to a printer and relates more particularly to a printer that prints by bidirectionally moving a carriage on which a print head is mounted.

2. Related Art

One type of printer is a roll paper printer such as taught in Japanese Unexamined Patent Appl. Pub. JP-A-2007-203563. Roll paper printers are commonly used for printing sales receipts and coupons that are issued based on product purchases.

Roll paper is typically stored in such roll paper printers with the rotational axis of the roll paper aligned with the width of the printer, and the printer prints on the roll paper by moving the print head mounted on a carriage bidirectionally widthwise to the printer while pulling paper from the paper roll.

Because they are used to print receipts and coupons, for example, roll paper printers are typically installed in limited space beside the cash register. Compact printers with a small width are therefore particularly desirable.

With the roll paper printer taught in JP-A-2007-203563, however, the drive shaft of the carriage drive motor extends horizontally, and when a motor that is wide in the direction of the drive shaft is used as the carriage drive motor, the depth of the roll paper printer in that direction necessarily becomes larger.

SUMMARY

The compact printer according to the invention solves the foregoing problem. Some aspects of the invention that solve at least part of the problem described above are described below.

A first aspect of the invention is a printer including: a first frame panel; a second frame panel disposed opposite the first frame panel; a guide shaft of which one end is supported by the first frame panel and the other end is supported by the second frame panel; a carriage that carries a print head and which moves bidirectionally along the guide shaft; a carriage drive motor that drives the carriage; a first pulley and a second pulley that are disposed between the first frame panel and the second frame panel; a belt that is connected to the carriage and is mounted on the first pulley, the second pulley, and the carriage drive motor; an ink cartridge storage unit that holds an ink cartridge storing ink that is supplied to the print head; and a recording medium transportation motor that conveys a recording medium. The first pulley and the second pulley are disposed to limit the range of bidirectional movement of the carriage so that the maximum width of bidirectional carriage movement is substantially equal to the distance between the first frame panel and the second frame panel. The ink cartridge storage unit is disposed between the first frame panel and the second frame panel on the first frame panel side. The recording medium transportation motor is disposed between the first frame panel and the second frame panel on the second frame panel side.

In a printer according to another aspect of the invention the carriage drive motor is disposed with the drive shaft thereof perpendicular to the scanning plane of the carriage.

A printer according to another aspect of the invention also has a tube that is part of an ink path for supplying ink stored in the ink cartridge to the print head, is disposed between the first frame panel and the second frame panel, changes shape in conjunction with carriage movement, and is disposed curving convexly from the first frame panel side toward the second frame panel side; and the carriage drive motor is disposed on the first frame panel side so that part of the carriage drive motor is enclosed by the convexly curved tubing.

A printer according to another aspect of the invention also has a transportation roller that is disposed between the first frame panel and the second frame panel and conveys the recording medium; and a transmission mechanism that is disposed between the first frame panel and the second frame panel and transmits drive power from the recording medium transportation motor to the transportation roller.

A printer according to another aspect of the invention also has a third pulley that is disposed between the first pulley and the second pulley, has the belt mounted thereon, and prevents interference between the belt and the recording medium transportation motor.

Another aspect of the invention is a printer including: a pair of frame panels; a guide shaft of which the ends are supported by the pair of frame panels; a carriage on which a print head is mounted and which moves bidirectionally along the guide shaft; a carriage drive motor that drives the carriage; a first pulley and a second pulley that are disposed between the pair of frame panels; a belt that is connected to the carriage and is mounted on the first pulley, the second pulley, and the carriage drive motor; a tube that is part of an ink path for supplying ink stored in an ink cartridge to the print head, is disposed between the pair of frame panels, and changes shape in conjunction with carriage movement. The carriage drive motor is disposed in the space in which the tube is located with the drive shaft perpendicular to the scanning plane of the carriage, and the first pulley and the second pulley are disposed to limit the range of bidirectional movement of the carriage so that the maximum width of bidirectional carriage movement is substantially equal to the distance between the pair of frame panels.

Further preferably in the printer according to this aspect of the invention the tube is disposed curving convexly one way in the direction of opposition between the pair of frame panels; and the carriage drive motor is disposed on the opposite side as the direction in which the tube curves convexly.

Yet further preferably in the printer according to this aspect of the invention, the tube curves in one direction in the direction of carriage movement, and is disposed to enclose part of a side of the carriage drive motor.

Yet further preferably, this printer also has a transportation roller that is disposed between the pair of frame panels and conveys the recording medium; and a recording medium transportation motor that is disposed between the pair of frame panels and drives the transportation roller. The carriage drive motor is disposed closer to one frame panel and the recording medium transportation motor is disposed closer to the other frame panel.

Yet further preferably, the printer also has a transmission mechanism that is disposed between the pair of frame panels and transmits drive power from the recording medium transportation motor to the transportation roller.

Yet further preferably, the printer also has a third pulley that is disposed between the first pulley and the second pulley, has the belt mounted thereon, and prevents interference between the belt and the recording medium transportation motor.

Yet further preferably, the printer also has an ink cartridge storage unit that is disposed between the pair of frame panels, holds the ink cartridge, and is disposed on the one frame panel side.

Another aspect of the invention is a printer having: a print head; a carriage that carries the print head and moves bidirectionally along a guide shaft; a carriage drive motor that drives the carriage; a first frame part that supports one end of the guide shaft; a second frame part that supports the other end of the guide shaft; a first pulley that is disposed proximally to the first frame part between the first frame part and the second frame part; a second pulley that is disposed proximally to the second frame part between the first frame part and the second frame part; a belt that is connected to the carriage and is mounted on the first pulley, the second pulley, and the carriage drive motor; and a tube that is part of an ink path for supplying ink stored in an ink cartridge to the print head, and changes shape in conjunction with carriage movement. The carriage drive motor is disposed with the drive shaft thereof closer to the second frame part than the first pulley, and closer to the first frame part than the second pulley. The first pulley and the second pulley limit the range of bidirectional movement of the carriage. A first end of the tube is connected to a first connection port, and the second end of the tube is connected to a second connection port disposed to the carriage. The first connection port is positioned in the direction of carriage movement closer to the first frame part than the drive shaft of the carriage drive motor, and is positioned in the direction perpendicular to the rotational axes of the first and the second pulleys on the opposite side of the drive shaft of the carriage drive motor as the side on which the carriage is positioned; and the tube is disposed passing between the carriage drive motor and the second frame part from the first connection port to the second connection port.

The printer according to this aspect of the invention preferably also has an ink cartridge storage unit that stores an ink cartridge holding ink that is supplied to the print head, the ink cartridge storage unit disposed between the first frame part and the second frame part.

Yet further preferably, the printer also has a recording medium transportation motor that is disposed between the first frame part and the second frame part, and conveys the recording medium. In this aspect of the invention the ink cartridge storage unit is disposed on the first frame part side, and the recording medium transportation motor is disposed on the second frame part side of the carriage drive motor.

Yet further preferably, the printer also has a transportation roller that conveys the recording medium printed on by the print head; a recording medium transportation motor that drives the transportation roller; and a transmission mechanism that transmits drive power from the recording medium transportation motor to the transportation roller. The transportation roller, the recording medium transportation motor, and the transmission mechanism are disposed between the first frame part and the second frame part.

The printer according to this aspect of the invention preferably also has a third pulley that is disposed between the first pulley and the second pulley, has the belt mounted thereon, and prevents interference between the belt and the recording medium transportation motor.

Further preferably, the carriage drive motor is disposed with the drive shaft thereof parallel to the rotational axes of the first and second pulleys.

Yet further preferably, the carriage drive motor is disposed with the drive shaft thereof perpendicular to the scanning plane of the carriage.

In a printer according to the invention the first and second pulleys limit the range of bidirectional carriage movement so that the maximum width of the bidirectional movement of the carriage is substantially equal to the width between a pair of frame panels that determine the width of the printer. The full width of the printer can therefore be used as the range in which the carriage can move bidirectionally, and the width of the printer can therefore be limited to the smallest width necessary.

Furthermore, because the carriage drive motor in a printer according to the invention is disposed perpendicularly to the scanning plane of the carriage, a large space is not needed in the scanning direction in order to accommodate a carriage drive motor with a large width. A compact printer can therefore be provided. Note that the scanning plane is the plane defined by the main scanning direction, which is the direction in which the carriage moves bidirectionally, and the subscanning direction, which is the direction in which the recording medium is conveyed, and is generally a horizontal plane.

Furthermore, because the tube moves as the carriage moves bidirectionally, the carriage drive motor and the tube tend to interfere with each other if the carriage drive motor is disposed proximally to the tube. The tube curves in a convex line, and when the carriage moves bidirectionally the tube moves while changing shape to the convex side. Therefore, if the carriage drive motor is located in the direction on the opposite side as the direction in which the tube curves convexly, there is no interference between the tube and carriage drive motor when the carriage travels bidirectionally. The carriage drive motor can also be disposed proximally to the tube without interference between the tube and the carriage drive motor. A compact printer can therefore be achieved.

Yet further, there is no need to provide a space to hold the transportation roller, recording medium transportation motor and transmission mechanism separately to the space between the pair of frame panels. The printer can therefore be rendered even more compactly.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

General Configuration

Figure 1:
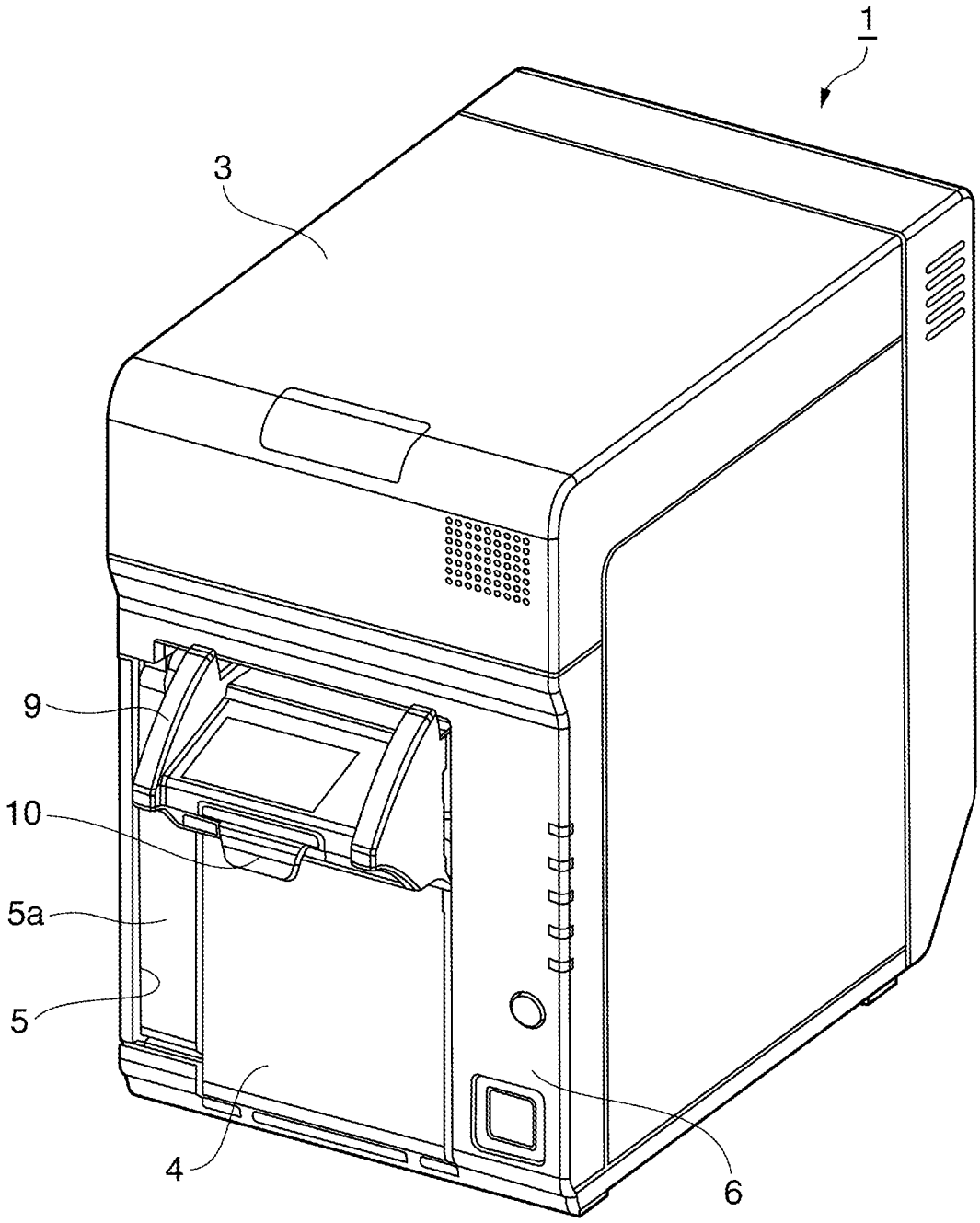
FIG. 1 is an external oblique view showing a printer according to a preferred embodiment of the invention.

FIG. 1 is an external oblique view of an inkjet roll paper printer 1 according to a preferred embodiment of the invention. The printer 1 includes a basically box-shaped printing assembly 2 (see FIG. 2), a case 3 that covers the sides and top of the printing assembly 2, and an access cover 4 disposed in the front middle part of the printing assembly 2. When closed as shown in FIG. 1, the access cover 4 closes a roll paper loading opening rendered in the front center part of the printing assembly 2. An ink cartridge insertion opening 5 is rendered at the front left side of the printing assembly 2, and a switch panel 6 populated with switches and indicators is disposed at the front right side of the printing assembly 2.

The access cover 4 can swing forward and open pivoting at the bottom end part of the cover. A paper exit 9 from which the roll paper is discharged after printing is disposed at the top of the access cover 4, and an open/close slider 10 that can slide forward is disposed at the front distal end of the paper exit 9. When the slider 10 is pulled forward, the access cover 4 pivots at the bottom end, exposing the roll paper compartment 13 (see FIG. 3) disposed inside the access cover 4 so that the roll paper can be dropped into the roll paper compartment 13.

Figure 2:
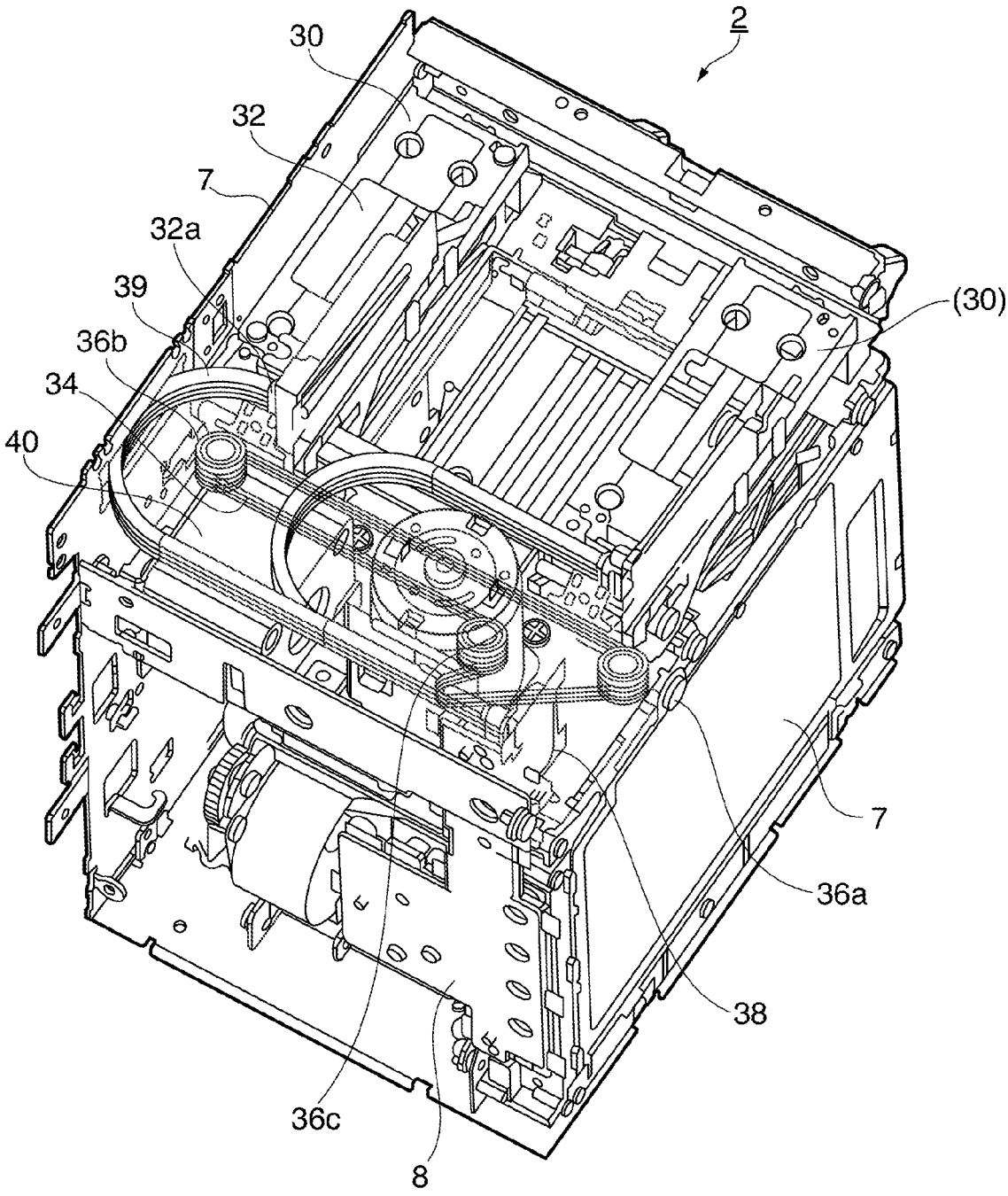
FIG. 2 is an oblique view from the back of the printer shown in FIG. 1 when the case is removed.

The ink stored in the ink cartridge 5*a* loaded in the ink cartridge storage unit located on the left side of the printing assembly 2 is pumped to a tube connection port 38 disposed at the top of the back frame 8 as shown in FIG. 2 by a pump not shown. In this embodiment of the invention four ink tubes 39 corresponding to four types of ink stored in the ink cartridge 5*a* are connected to the tube connection port 38 disposed at the top the ink cartridge storage unit. The four ink tubes 39 are connected to each other and rendered in unison. Indicators for displaying how much ink is left in the ink cartridge 5*a*, for example, and switches such as a roll paper feed switch are disposed to the switch panel 6 on the right side of the printing assembly 2.

FIG. 2 is an oblique view from the back (the opposite side as the access cover 4) of the printer 1 shown in FIG. 1 when the case 3 is removed. As shown in the figure the printing assembly 2 has a pair of left and right frame panels 7 (first and second frame units), and a back frame 8. All of the parts for operating the printer 1 are disposed between the pair of left and right frame panels 7 in the printer 1 according to this embodiment of the invention, and only the case 3 is located outside the left and right frame panels 7. The gap between the left and right frame panels 7 is therefore substantially equal to the width of the printer 1.

Paper Feed Mechanism

The roll paper compartment 13 (see FIG. 3) is disposed inside the widthwise center of the printer 1 facing the roll paper loading opening that is exposed when the access cover 4 is opened. More specifically, the roll paper used as the recording medium is loaded substantially in the center of the printer between the pair of left and right frame panels 7. The paper roll is loaded in the roll paper compartment 13 with the axis of roll paper rotation aligned with the width of the printer 1.

Figure 3:
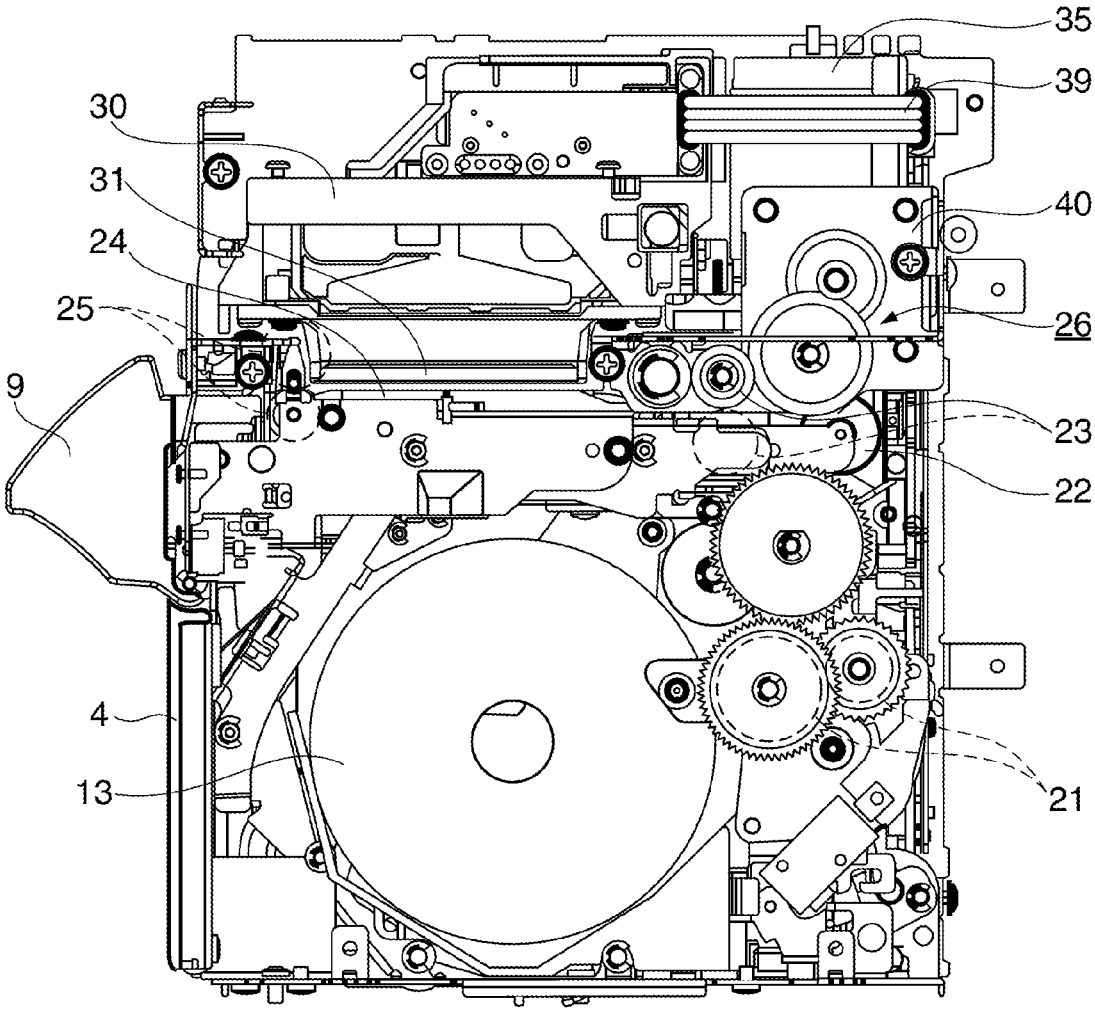
FIG. 3 is a side view of the printer in FIG. 2 with the frame panel removed.

As also shown in FIG. 3, a pair of supply rollers 21, a tension roller 22, and a pair of main feed rollers 23 are disposed in order from the bottom to the top behind the roll paper compartment 13. A platen 24 and a pair of front feed rollers 25 are also disposed between the main feed roller 23 and the access cover 4.

The roll paper is pulled from the roll paper compartment 13, conveyed passed the pair of supply rollers 21, the tension roller 22, the pair of main feed rollers 23, the platen 24, and the pair of front feed rollers 25, and discharged from the paper exit 9. The supply rollers 21, main feed rollers 23, and front feed rollers 25 are also collectively referred to as transportation rollers. These transportation rollers are driven by a paper feed (transportation) motor 40 through an intervening power transmission mechanism 26 (see FIG. 3, FIG. 4) having gears or a belt and pulleys, for example.

The pair of supply rollers 21 disposed at the back of the roll paper compartment 13 pull the roll paper from the roll paper compartment 13 and apply paper feed force to the roll paper.

The tension roller 22 is disposed to apply appropriate back tension to the roll paper. The tension roller 22 is configured so that it can move in the roll paper feed direction and is urged opposite the paper feed direction (to the upstream side) by a spring or other urging means. When excessive back tension is applied to the roll paper, the tension roller 22 moves in the forward paper feed direction (the downstream side) and reduces the back tension. When the back tension is less than a specified level, the tension roller 22 moves opposite the paper feed direction and applies appropriate back tension to the roll paper.

The tension roller 22 thus stabilizes paper feed precision by moving in the normal paper feed direction and maintaining a constant load on the main feed roller 23. When the roll paper is conveyed at a high paper feed rate, the tension roller 22 moves in the normal paper feed direction so that the roll paper can be conveyed at high speed without the roll paper tearing.

The main feed rollers 23 are disposed between the tension roller 22 and the front feed roller 25, and conveys the roll paper at a constant pitch. The main feed rollers 23 are therefore highly precisely controlled.

The front feed rollers 25 are disposed between the platen 24 and paper exit 9. The front feed rollers 25 apply sufficient pressure to the roll paper while conveying the roll paper, and prevent jams that can occur when the roll paper is pulled perpendicularly to the paper feed direction. The front feed rollers 25 also prevent the roll paper from lifting away from the surface of the platen 24. To apply sufficient pressure, the front feed rollers 25 are preferably cylindrical rollers with an axial length that is longer than the roll paper width.

Carriage Mechanism

Figure 4:
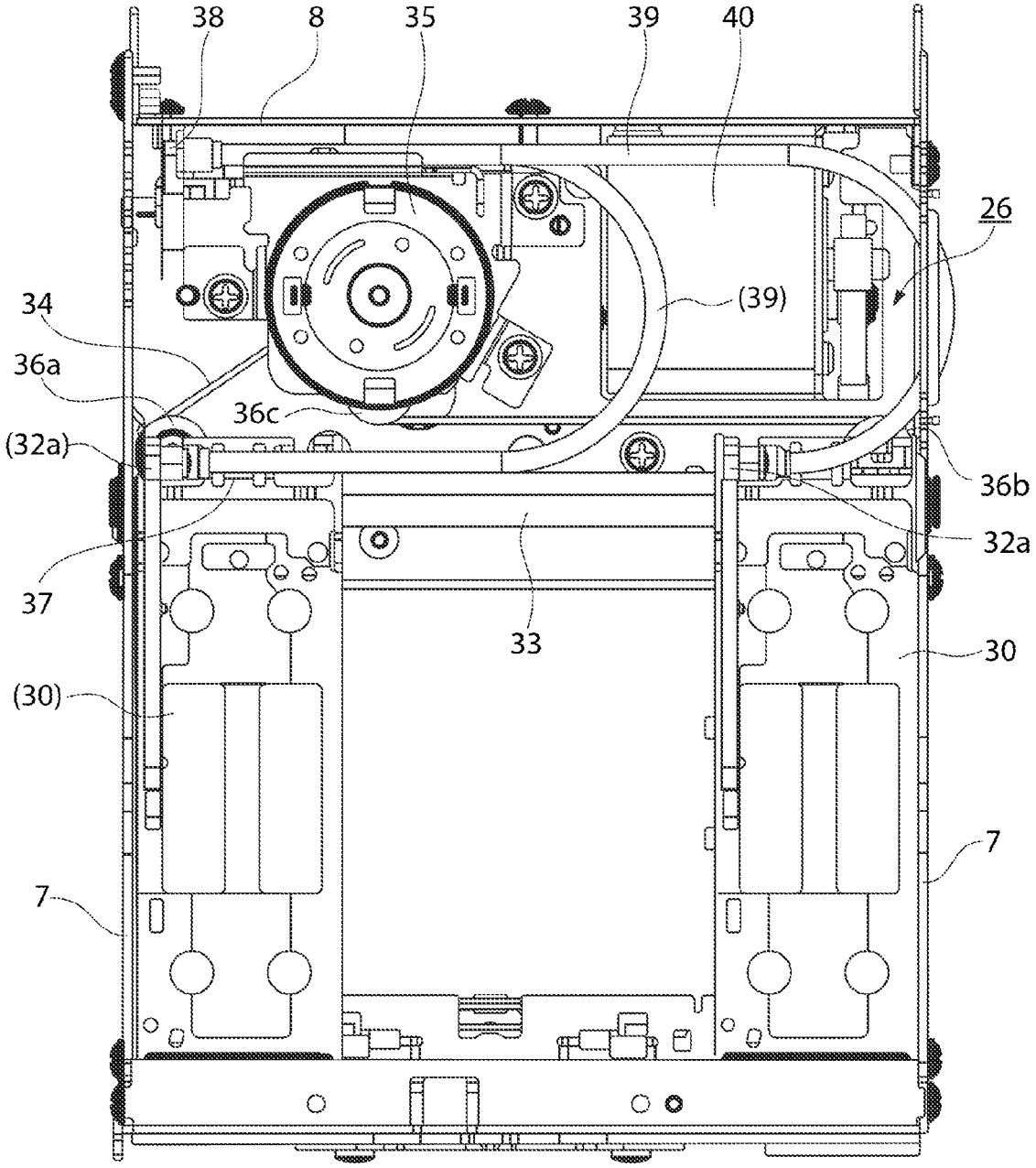
FIG. 4 is a top plan view of the printer in FIG. 2.

As shown in FIG. 2 and FIG. 4, a carriage 30 is disposed movably bidirectionally widthwise to the printer 1 above the platen 24. Note that FIG. 2 and FIG. 4 show the positions of the carriage 30 at both ends of the range of bidirectional movement. An inkjet head 31 (print head) disposed opposite the platen 24, and an ink damper 32 that temporarily stores ink supplied from the ink cartridge 5*a* through the ink tubes 39 (tube), are disposed to the carriage 30. The ink cartridge 5*a* is installed in an ink cartridge storage unit located between the pair of frame panels 7 near the frame panel 7 on the left side.

The ink stored in the ink cartridge 5*a* is pumped by a pump not shown to a tube connection port 38 disposed at the back at the top of the printing assembly 2. The ink that reaches the tube connection port 38 is supplied to the ink damper 32 by the flexible ink tubes 39 connecting the tube connection port 38 (first connection port) and the tube connection port 32*a* (second connection port) of the ink damper 32 disposed to the carriage 30.

The ends of a guide shaft 33 extending widthwise to the printer 1 are supported by the pair of left and right frame panels 7. The carriage 30 is supported movably widthwise to the printer 1 by the guide shaft 33, and is driven bidirectionally by a carriage drive motor 35 through an intervening endless belt 34.

First and second pulleys 36*a* and 36*b* are disposed at opposite ends of the direction of bidirectional carriage 30 movement in the space between the pair of left and right frame panels 7. The first and second pulleys 36*a* and 36*b* are disposed with their axes of rotation perpendicular to the direction of carriage 30 movement. The first pulley 36*a* is disposed on the side near the carriage drive motor 35 inside of the left frame panel 7, and the second pulley 36*b* is disposed on the side far from the carriage drive motor 35 inside the right frame panel 7. The first and second pulleys 36*a* and 36*b* limit the range of bidirectional movement of the carriage 30 so that the maximum width of the bidirectional movement of the carriage 30 is approximately equal to the width between the pair of left and right frame panels 7.

A third pulley 36*c* is provided to reduce the area occupied by the endless belt 34. As shown in FIG. 2 and FIG. 4, interference between the endless belt 34 and the paper feed motor 40 described below can be avoided by disposing the third pulley 36*c* near the carriage drive motor 35. When a third pulley 36*c* is not provided, the endless belt 34 located between the second pulley 36*b* and carriage drive motor 35 interferes with the paper feed motor 40. If there is no interference with other parts, the third pulley 36*c* may obviously be omitted.

The endless belt 34 is mounted on the first, second, and third pulleys 36*a*, 36*b*, and 36*c*, and a gear 35*a* (see FIG. 5) on the drive shaft of the carriage drive motor 35, and drives the carriage 30 by means of the drive power from the carriage drive motor 35. A connector 37 that holds the carriage 30 immovably to the endless belt 34 is disposed between the endless belt 34 and carriage 30.

Figure 5:
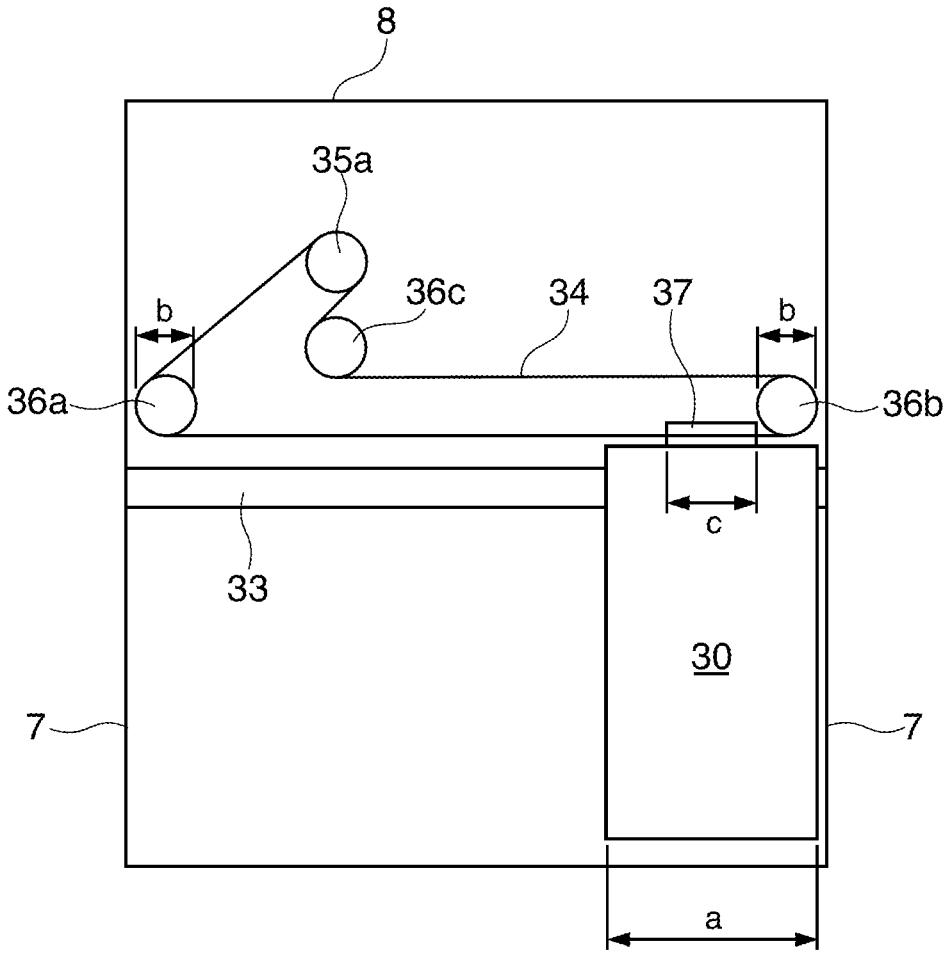
FIG. 5 is a top schematic view of the printer in FIG. 2 describing the relationship between the width of the carriage, the diameters of first and second pulleys, and the width of a connecting member.

As shown in FIG. 5, when the connector 37 is fastened at the middle of the width of the carriage 30, the relationship between the width a of the carriage 30, the diameter b of the first and second pulleys 36*a* and 36*b*, and the width c of the connector 37 is preferably $a \leq 2b+c$. If the parts are designed so that $a=2b+c$, for example, the width $\{(a-c)/2\}$ of the part on the second pulley 36*b* side of the carriage 30 connector 37 will be the same as the diameter b of the second pulley 36*b* when the carriage 30 is positioned on the second pulley 36*b* side. Therefore, even if the first and second pulleys 36*a* and 36*b* are located near the frame panels 7, the carriage 30 will not contact the frame panels 7, and there is no need to design the carriage 30 with a smaller width than necessary.

The ink tubes 39 are disposed in the space between the back frame 8 and the carriage 30. The ink tubes 39 form part of the ink path from the ink cartridge 5*a* to the inkjet head 31. More specifically, the ink tubes 39 form the ink path through which ink is supplied from the tube connection port 38 affixed to the first pulley 36*a* side of the back frame 8 to the carriage 30 (ink damper 32) that moves bidirectionally between the first and second pulleys 36*a* and 36*b*.

The ink tubes 39 are made from a flexible material. To allow the carriage 30 to move bidirectionally, the ink tubes 39 are disposed curving convexly toward the second pulley 36*b* side. In other words, the ink tubes 39 are disposed between the opposing faces of the pair of frame panels 7 curving in a U-shaped loop from the side at the left frame panel 7 toward the side at the right frame panel 7. Described yet differently, the ink tubes 39 are disposed in a curve that bulges in the direction of carriage 30 movement (the guide shaft 33) to the second pulley 36*b* side (the right frame panel 7 side). Described yet differently, the ink tubes 39 are disposed from a fixed end at the tube connection port 38 passing between the carriage drive motor 35 and right frame panel 7 to the tube connection port 32*a* (carriage 30) at the free end.

In addition, the ink tubes 39 move while changing shape in the direction of bidirectional movement of the carriage 30 so that the curved part of the ink tubes 39 moves in the long direction of the ink tubes 39 in conjunction with bidirectional movement of the carriage 30.

The carriage drive motor 35 is disposed on the opposite side of the ink tubes 39 as the direction in which the ink tubes 39 curve in a U-shape. Because the ink tubes 39 curve out towards the second pulley 36*b* in the example in FIG. 4, the carriage drive motor 35 is disposed at the opposite end of the ink tubes 39 as the second pulley 36*b*, that is, on the first pulley 36*a* side. In other words, the carriage drive motor 35 is disposed in the space between the back frame 8 and the area of bidirectional movement of the carriage 30 on the first pulley 36*a* side of the ink tubes 39 when the carriage 30 is positioned at the end of the range of bidirectional movement on the first pulley 36*a* side. As shown in FIG. 2 to FIG. 4, the carriage drive motor 35 is disposed so that at least part of its side is within the curve of the ink tubes 39.

In this embodiment of the invention the ink tubes 39 are disposed between the pair of frame panels 7 with one end connected to the tube connection port 38 disposed on the first pulley 36*a* side and the other end connected to the carriage 30. In the direction of carriage 30 movement, the tube connection port 38 is positioned closer to the left frame panel 7 (first pulley 36*a*) than the drive shaft of the carriage drive motor 35, and in the direction perpendicular to the rotating shafts of the first and second pulleys 36*a* and 36*b* is positioned on the opposite side of the carriage drive motor 35 drive shaft as the side on which the carriage 30 is positioned.

When the carriage 30 is positioned on the first pulley 36*a* side, the ink tubes 39 curve in a U-shaped configuration, and when the carriage 30 is on the second pulley 36*b* side, the ink tubes 39 curve in a J-shaped configuration. As the carriage 30 moves from the first pulley 36*a* side to the second pulley 36*b* side, the ink tubes 39 gradually change from the U-shaped configuration to the J-shaped configuration. At this time the ink tubes 39 move (change shape) extending along the back frame 8. Therefore, if the carriage drive motor 35 is disposed on the opposite side of the ink tubes 39 as the direction in which ink tubes 39 curve away from the first pulley 36*a* when the carriage 30 is positioned on the first pulley 36*a* side, there will be no interference between the carriage drive motor 35 and the ink tubes 39.

The carriage drive motor 35 is thus positioned on the opposite side as the direction in which the ink tubes 39 curve in a U-shaped or J-shaped configuration so that there is no interference between the carriage drive motor 35 and the ink tubes 39. In other words, the carriage drive motor 35 is located on the inside of the U when the ink tubes 39 are curved in a U-shape. The carriage drive motor 35 may further alternatively be said to be located in the area substantially enclosed by the ink tubes 39 when the carriage 30 is positioned on the side of the left frame panel 7 disposed close to the tube connection port 38 and the first pulley 36*a* disposed close to the left frame panel 7.

The drive shaft of the carriage drive motor 35 is disposed perpendicularly to the scanning plane. The scanning plane is the plane defined by the main scanning direction, which is the direction in which the inkjet head 31 moves bidirectionally, and the subscanning direction, which is the direction in which the roll paper travels over the platen 24. Because the scanning plane is horizontal in this embodiment of the invention, the drive shaft of the carriage drive motor 35 is vertical.

When the drive power of the carriage drive motor 35 is increased in order to improve the printing speed, high output can be achieved by arranging stators in the axial direction, and motors that are large in the axial direction may be used as the carriage drive motor 35. If the motor is disposed so that the drive shaft extends parallel to the scanning plane (that is, extends horizontally), the space that is needed in the printer 1 in the axial direction of the motor increases as motor output increases. However, if the drive shaft of the motor is disposed perpendicularly to the scanning plane as in this embodiment of the invention, the space needed in the scanning plane direction to house the motor is not increased even if a high output motor is used, and a compact printer 1 with a small footprint can be achieved.

As described above, the carriage 30, guide shaft 33, endless belt 34, carriage drive motor 35, first and second pulleys 36*a* and 36*b*, tube connection port 38, and ink tubes 39 are also disposed between the pair of left and right frame panels 7.

Paper Feed Motor

As shown in FIG. 3 and FIG. 4, the paper feed motor 40 is disposed between the pair of left and right frame panels 7. That is, the paper feed motor 40 is not located outside the maximum width of the bidirectional movement of the carriage 30. More specifically, the paper feed motor 40 is disposed between the tube connection port 38 and carriage 30, and on the roll paper compartment 13 side of the ink tubes 39 (that is, below the ink tubes 39 in FIG. 3). More specifically, the paper feed motor 40 is disposed in the space between the back frame 8 and the guide shaft 33, and below the space where the ink tubes 39 is disposed. Because the paper feed motor 40 is thus located below the ink tubes 39 that move horizontally in conjunction with carriage 30 movement, a compact printer 1 with a small footprint can be achieved, and there is no interference between the ink tubes 39 and paper feed motor 40.

Note that in this embodiment of the invention as shown in FIG. 2 and FIG. 4 the carriage drive motor 35 and paper feed motor 40 are disposed side by side along the guide shaft 33, the carriage drive motor 35 is disposed on the first pulley 36*a* (left frame panel 7) side, and the paper feed motor 40 is disposed on the second pulley 36*b* (right frame panel 7) side. However, the paper feed motor 40 is disposed so that the drive shaft thereof is parallel to the carriage scanning plane. That is, the carriage drive motor 35 and paper feed motor 40 are disposed so that their drive shafts are perpendicular to each other.

The paper feed motor 40 drives the supply roller 21, main feed rollers 23, and front feed rollers 25 through a gear train or drive belt and pulley mechanism. The transportation rollers such as the supply rollers 21, main feed rollers 23, and front feed rollers 25, the power transmission mechanism 26 such as gear train or drive belt and pulley mechanism, and the paper feed motor 40 are also disposed between the pair of left and right frame panels 7. Because the members for conveying the roll paper are disposed inside the pair of left and right frame panels 7, and only the case 3 is outside the frame panels 7, the gap between the left and right frame panels 7 is substantially equal to the width of the printer 1. Because this configuration does not need space to accommodate the paper feed rollers and power transmission mechanism 26 in addition to the movement of the inkjet head 31 (carriage 30), the width of the printer 1 can be made substantially equal to the movement range of the inkjet head 31, and a printer 1 with a small width can be achieved.

Because the maximum width of the bidirectional movement of the carriage 30 is substantially the same as the width between the pair of frame panels 7 in a roll paper printer 1 according to this embodiment of the invention, the overall width of the printer 1 can be made substantially equal to the range of inkjet head 31 movement, and the printer 1 can be rendered with a compact width.

In addition, because the drive shaft of the carriage drive motor 35 is disposed perpendicularly to the scanning plane, that is, vertically, a carriage drive motor 35 that is long in the axial direction can be used without increasing the depth of the printer.

A compact printer with a small footprint can thus be provided.

The invention is described with reference to a preferred embodiment thereof above, and it will be obvious to one with ordinary skill in the related art that the invention can be changed and modified in many ways without departing from the scope of the accompanying claims.

For example, the ink cartridge 5*a* is disposed on the left side of the printing assembly 2 and switches are disposed on the right side of the printing assembly 2 in the foregoing embodiment, but the positions of these may be reversed. In addition, the tube connection port 38 is disposed on the first pulley 36*a* side, but may be disposed on the second pulley 36*b* side.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a pair of frame panels;

a guide shaft of which the ends are supported by the pair of frame panels;

a carriage on which a print head is mounted and which moves bidirectionally along the guide shaft;

a carriage drive motor having a drive shaft that drives the carriage;

a first pulley and a second pulley that are disposed between the pair of frame panels;

a belt that is connected to the carriage and is mounted on the first pulley at a first point, the second pulley at a second point, and the carriage drive motor at a third point;

a tube that is part of an ink path for supplying ink stored in an ink cartridge to the print head, is disposed between the pair of frame panels, and changes shape in conjunction with carriage movement;

wherein the carriage drive motor is disposed in the space in which the tube is located with the drive shaft perpendicular to the scanning plane of the carriage, and the first pulley and the second pulley are disposed to limit the range of bidirectional movement of the carriage so that the maximum width of bidirectional carriage movement is substantially equal to the distance between the pair of frame panels.

2. The printer described in claim 1, wherein:

the tube is disposed curving convexly one way in the direction of opposition between the pair of frame panels;

the carriage drive motor being disposed on the opposite side as the direction in which the tube curves convexly.

3. The printer described in claim 1, wherein:

the tube curves in one direction in the direction of carriage movement, and is disposed to enclose part of a side of the carriage drive motor.

4. The printer described in claim 1, further comprising:

a transportation roller that is disposed between the pair of frame panels and conveys the recording medium; and a recording medium transportation motor that is disposed between the pair of frame panels and drives the transportation roller, wherein the carriage drive motor is disposed closer to one frame panel and the recording medium transportation motor is disposed closer to the other frame panel.

5. The printer described in claim 4, further comprising:

a transmission mechanism that is disposed between the pair of frame panels and transmits drive power from the recording medium transportation motor to the transportation roller.

6. The printer described in claim 4, further comprising:

a third pulley that is disposed between the first pulley and the second pulley, has the belt mounted thereon, and prevents interference between the belt and the recording medium transportation motor.

7. The printer described in claim 4, further comprising:

an ink cartridge storage unit that is disposed between the pair of frame panels, holds the ink cartridge, and is disposed on the one frame panel side.

* * * * *